United States Patent [19]

Kerby

[11] 4,257,132

[45] Mar. 24, 1981

[54] COLLAPSIBLE POOL COVER ASSEMBLY

[76] Inventor: Frederick A. Kerby, 507 Elizabeth Rd., Glen Burnie, Md. 21061

[21] Appl. No.: 78,340

[22] Filed: Sep. 24, 1979

Related U.S. Application Data

[63] Continuation of Ser. No. 936,967, Aug. 25, 1978, abandoned.

[51] Int. Cl.[3] ..... E04H 3/19; E04B 1/32; A45F 1/02

[52] U.S. Cl. ..... 4/498; 4/503; 52/86; 135/3 R

[58] Field of Search ..... 4/172, 172.14, 172.12, 4/488, 494, 496, 498, 500, 503, 504, 534, 557, 580; 135/1 R, 3 R, 4 R; 52/63, 86

[56] References Cited

U.S. PATENT DOCUMENTS

| | | | |
|---|---|---|---|
| 2,964,759 | 12/1960 | Riggs | 4/172.12 |
| 3,461,890 | 8/1969 | Goodrich | 4/172.12 X |
| 3,469,587 | 9/1969 | Folkes | 4/172.12 X |
| 3,534,412 | 10/1970 | Crook | 4/172.12 |
| 4,051,638 | 10/1977 | Heintz | 4/172.12 |
| 4,122,562 | 10/1978 | Sorrentino | 4/172.12 |
| 4,136,408 | 1/1979 | Dahlbeck et al. | 4/172.12 |

*Primary Examiner*—Stuart S. Levy

*Attorney, Agent, or Firm*—Pollock, Vande Sande and Priddy

[57] ABSTRACT

A collapsible cover assembly for use with a swimming pool having a curved edge or coping extending along opposite sides thereof, wherein the cover assembly includes a plurality of slidably extendable support members each forming an arch across the pool to support a cover member positioned thereon, with each support member further including a curved foot member mounted on opposite ends which overlie and provide attachment with the pool coping.

6 Claims, 4 Drawing Figures

Fig. 1
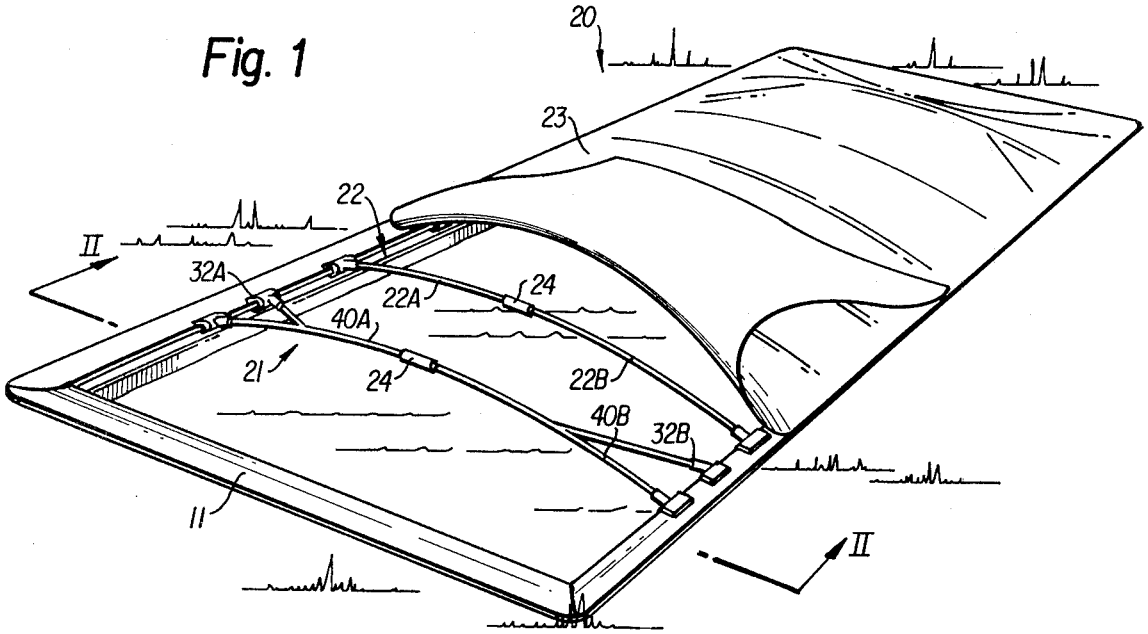
Fig. 2
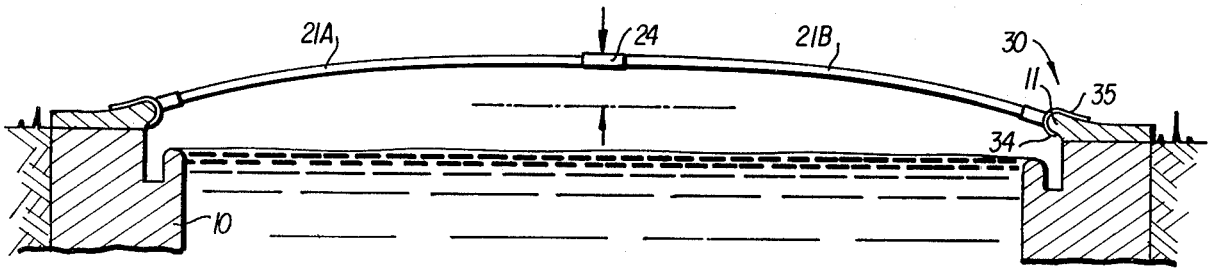
Fig. 3
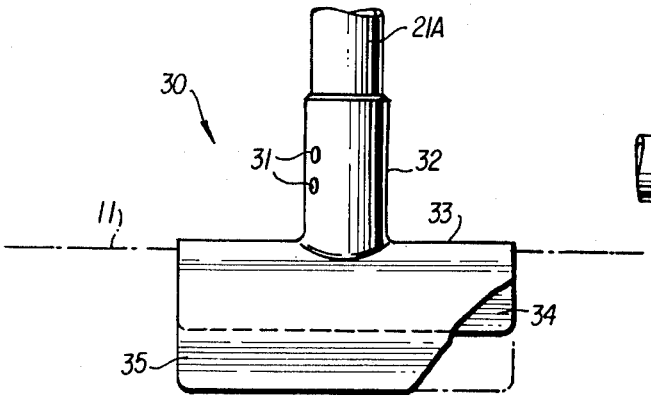
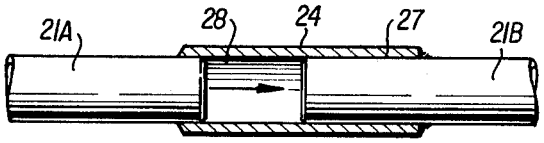
Fig. 4

COLLAPSIBLE POOL COVER ASSEMBLY

This is a continuation of application Ser. No. 936,967, filed Aug. 25, 1978; now abandoned.

BACKGROUND OF THE INVENTION

The present invention relates generally to a collapsible cover assembly adaptable for use with a substantially rectangularly-shaped swimming pool. In particular, the present invention is directed to an extendable cover support structure that is intended to overlie and attach to an existing standard pool coping, thereby eliminating the need for any additional base assembly.

While swimming pool cover assemblies are well known in the prior art, known cover assemblies usually require the support structure to be attached to an elaborate frame assembly which must be first postioned about the pool. Furthermore, because known cover support members are fixedly attached to a base frame, they cannot be later moved relative to one another to provide additional support for the cover. Finally, known pool cover support members are generally not slidably extendable to adjust for the weight or water or debris which tends to gather on the pool cover over a period of time.

OBJECTS OF THE INVENTION

It is an important object of this invention to provide a novel cover assembly including a plurality of support members each formed with a novel foot assembly mounted on opposide ends to overlie an extending standard pool coping and provide attachment therewith.

It is a further object of the invention to achieve the preceding object while constructing each cover support member from two parts, with one of the parts slidably extending into a hollow sleeve attached to the remaining part.

It is a further object of the invention to provide a novel dome-shaped pool cover support assembly for preventing water and debris from accumulating on the cover over an extended period of time.

It is a still further object of the invention to provide a cover assembly which is inexpensive to manufacture and simple to install.

These and other objects of the present invention will become apparent from a reading of the following specification and claims, together with the accompanying drawings, wherein similar elements are referred to and indicated by similar reference numerals.

As will be discussed in detail hereinafter, applicant's new and useful invention overcomes the assembly problems confronting known pool cover assemblies, while at the same time providing an inexpensive dome-shaped pool cover assembly which is conveniently attachable directly to an existing pool coping, thereby avoiding the need for a costly and cumbersome base assembly.

BRIEF DESCRIPTION OF THE DRAWINGS

The present invention can be best understood with reference to the accompanying drawings, wherein:

FIG. 1 shows a perspective view of a substantially rectangularly-shaped swimming pool enclosed by a cover assembly constructed according to the present invention;

FIG. 2 shows a cross-sectional view of the cover assembly taken along section II—II to FIG. 1, wherein the support members overlie and attach with the existing pool coping;

FIG. 3 shows a partial cut away view of a novel T-shaped foot assembly according to the present invention; and FIG. 4 shows a view of a sleeve assembly for slidably engaging each pair of support members.

DETAILED DESCRIPTION OF THE PREFERRED EMBODIMENT

With reference to the drawings, and FIGS. 1 and 2 in particular, a substantially rectangularly-shaped swimming pool is indicated generally at 10. Pool 10 includes a standard coping or rounded edge portion 11 extending completely about pool 10 which may conveniently provide a rest grip for swimmers as well as a protective raised edge preventing walkers from accidently falling into pool 10.

As will be discussed in detail hereinafter, applicant's invention makes use of standard coping 11 to provide a base for supporting a collapsible pool cover assembly generally indicated at 20. By attaching cover assembly 20 directly to coping 11, the need for a costly and cumbersome base is eliminated.

Cover assembly 20 includes a plurality of generally arch-shaped support members extending between coping 11 formed along opposite lengthwise sides of pool 10. Two of the support members 21 and 22, respectively, are shown in FIG. 1, with a plurality of similarly-shaped support members extending beneath partially raised cover member 23, and therefore not visible. The plurality of support members are evenly spaced along the length of pool 10 to provide plurality of support for a cover 23 which is shown in a partially raised position in FIG. 1.

Support members 21 and 22 each include a pair of separate, pole-shaped sections 21A, 21B and 22A, 22B, respectively. In a similar manner, each of the additional support members hidden beneath cover 23 are also formed from two pole-shaped sections.

A hollow sleeve member 24 is slidably attached to adjacent ends of pole sections 21A and 21B, as well as to each of the remaining pairs of adjacent pole section ends (not shown). In a preferred embodiment, sleeve 24 is attached to pole 21B by conventional fasteners such as pins, screws or welding. A free end of pole 21A is inserted into sleeve 24 and abuts the end of pole 21B as shown in FIG. 4. If would, of course, be within the scope of the present invention to attach sleeve 24 to pole 21A and insert pole 21B into sleeve 24. It is noted that poles 21A and 21B can be easily separated by sliding the appropriate pole from sleeve 24, allowing for easy storage when not in use.

During assembly of composite support member 21, pole section 21B is first pressed into and attached to an end 27 of sleeve 24. An end of pole section 21A is then properly aligned with and inserted into an end 28 of sleeve 24. Each of the composite support members 21 extending beneath cover 23 is similarly engaged through the use of a connecting sleeve 24 for engaging adjacent end portions of the respective poles.

A novel assembly 30 is connected to an end portion of each of the pole sections 21A and 21B remote from the end inserted into sleeve 24. Foot assemblies 30 may be connected to the pole sections 21A and 21B via conventional bolts 31, as shown in FIG. 3 or, alternatively, foot assemblies 30 may be connected by conventional fasteners, such as pins, screws or even welding. In a yet further alternative embodiment, each pole section 21A and 21B and its respective foot assembly 30 is formed as an integral member.

Foot assembly 30 is substantially T-shaped and includes a hollow sleeve portion 32 integrally attached to a curved base portion 33. Base portion 33 is formed with a partially curcular cross-sectional shape, similar in shape to the curved portion of coping 11. Base portion 33 is divided into first and second surfaces 34 and 35, respectively, which overlie opposite sides of coping 11 to provide attachment between assembly 30 and coping 11. Preferaly, surface 35 extends a greater distance as compared to surface 34 to prevent attached support members 21 from pivoting out of contact with coping 11.

End support member 21 includes a further pair of pole sections 40A and 40B which extend between coping 11 and pole sections 21A and 21B, respectively to provide additional support for cover 23. It is noted that the sleeve portions 32A, 32B mounted on pole sections 40A and 40B must be angled with respect to base portions 33A and 33B as shown in FIG. 1. The opposite end support member also includes a pair of additional pole sections positioned similar to pole sections 40A and 40B.

In the present embodiment, cover 23 is merely placed over the plurality of arch-shaped support members during installation. In a further embodiment, cover 23 may be formed with a plurality of conventional fasteners, such as snaps, for attachment to similar snaps formed on the plurality of foot assemblies 30. In a yet further embodiment, cover 30 may be held in place by a plurality of weights, such as bricks, positioned around the edge thereof.

The present invention is not limited to the abovedescribed embodiments, but is limited only by the scope of the following calims.

I claim:

1. An improved, collapsible swimming pool cover support assembly for providing the entire support for a swimming pool cover even when weighed down by leaves, snow and the like, and comprising:

a plurality of substantially arch-shaped support members free-standing relative to one another and extending substantially parallel to one another between, curved edge portions or copings of said swimming pool foot means for making each said standing relative to one another to prevent lateral shifting substantially arch-shaped support members free or twisting of the arch shaped supports, separate pairs of foot means extending between opposite end portions of said arch-shaped, free-standing support members and said pool coping for providing the entire lateral and transverse support for said respective free-standing support members;

each of said foot means consisting of a T-shaped foot assembly including a base portion having an integral curved cross-sectional shape overlapping and engaging said swimming pool coping, each of said foot means further comprising a portion of substantially rigid construction fixedly and non-rotatably engaging a confronting end portion of one of said support members to fixedly postion said free-standing arch-shaped support member relative to said curved edge portion of said pool even when said support member is subjected to lateral forces, the portion of the foot means overlapping and engaging the coping being elongated in a direction parallel to the coping so as to prevent lateral shifting or twisting of the arch-shaped supports wherein said foot means constitute the sole support for said arch-shaped support members; a cover member placed over said arch-shaped supports for covering said pool.

2. A pool cover assembly according to claim 1, wherein said plurality of support members are evenly spaced lengthwise along said pool to provide support for said cove member extending thereover.

3. A pool cover assembly according to claim 1, wherein said fastening means in each of said support members comprises a hollow sleeve member attached to one of said pole sections for receiving the adjacent end of the other pole section.

4. The pool cover assembly of claim 3 wherein said hollow sleeve member is slidable telescopically relative to said one of said pole sections.

5. A pool cover assembly according to claim 1, wherein each support member includes a pair of substantially similarly-shaped pole sections positioned in end-to-end arrangement relative to one another, at least one of each pair of pole sections forming a support member further including fastening means for releasably retaining a confronting end portion of the remaining pole section forming each pair.

6. A collapsible pool cover assembly according to claim 5, wherein an upper surface of each base portion is longer than a lower surface of each base portion to prevent accidental separation of said foot means from said coping.

* * * * *